US005544506A

United States Patent [19]

Nakano

[11] Patent Number: 5,544,506

[45] Date of Patent: Aug. 13, 1996

[54] AUXILIARY LOCK

[75] Inventor: Yoshio Nakano, Tokyo, Japan

[73] Assignee: Sanpou Lock Co., Ltd., Tokyo, Japan

[21] Appl. No.: 377,235

[22] Filed: Jan. 24, 1995

[30] Foreign Application Priority Data

Nov. 2, 1994 [JP] Japan ..... 6-269396

[51] Int. Cl.[6] ..... E05B 67/36

[52] U.S. Cl. ..... 70/34; 70/104; 292/302; 292/327

[58] Field of Search ..... 70/33, 34, 158, 70/163, 166, 169, 104; 292/302, 327

[56] References Cited

U.S. PATENT DOCUMENTS

| | | | |
|---|---|---|---|
| 599,245 | 2/1898 | Merrill | 70/33 |
| 2,656,704 | 10/1953 | Mancuso | 70/33 |
| 4,013,311 | 3/1977 | Prezioso | 292/302 |
| 4,015,868 | 4/1977 | Buttler | 292/302 |
| 4,347,720 | 9/1982 | Kenyon | 70/34 |
| 4,823,572 | 4/1989 | Signorelli | 70/34 |
| 4,887,444 | 12/1989 | de Brouwer-Elzen | 70/34 |
| 4,997,218 | 3/1991 | Culling | 292/302 |
| 5,255,542 | 10/1993 | Fortin | 70/34 |
| 5,265,451 | 11/1993 | Phifer | 70/226 |

*Primary Examiner*—Steven N. Meyers
*Assistant Examiner*—Tuyet-Phuong Pham
*Attorney, Agent, or Firm*—Nikaido, Marmelstein, Murray & Oram LLP

[57] ABSTRACT

An improved auxiliary lock for closing and fastening a movable part to a stationary part using a key is described. The device comprises a bolt assembly comprising an inner cylinder having a key hole and an outer cylinder encircling the inner cylinder, a first re-entrant engagement member to be fixed to the movable part and a second re-entrant engagement member to be fixed to the stationary part. The first and second re-entrant engagement members have holes made therein to be put in alignment when these re-entrant members are nested together with one projection of each engagement member inserted in the indentation of the counter engagement member. The bolt assembly is inserted in the through holes of these re-entrant engagement members when nested, thereby locking the movable part to the stationary part.

2 Claims, 3 Drawing Sheets

AUXILIARY LOCK

BACKGROUND OF THE INVENTION

1. Field of the Invention

The present invention relates to an auxiliary lock of the type which is used in automatic dispensers for prevention of thefts.

2. Description of Related Art

Usually the door of an automatic dispenser is locked and put in chain, which is used as auxiliary locking means. One end of tile chain is fastened to the body of the dispenser, and the other end of the chain is detachably connected to the door of the dispenser with the aid of an associated lock.

The chain, however, can be cut with a chain cutter. A length of chain which is thick enough to prevent the cutting of the chain by chain cutters is heavy and difficult in handling. Such a chain is massive, and is liable to extensively lie on the ground.

SUMMARY OF THE INVENTION

One object of the present invention is to provide an auxiliary lock which is guaranteed to be free of such defects as described, and is simple and compact, still increasing the resistance to breaking.

To attain this object an auxiliary lock for closing and Fastening a movable part to a stationary part by means of a key is improved in that it comprises; a bolt assembly comprising an inner cylinder having a key hole and an outer cylinder encircling the inner cylinder; a first re-entrant engagement member to be fixed to the movable part; and a second re-entrant engagement member to be fixed to the stationary part, said first and second re-entrant engagement members having holes made therein to be put in alignment when these re-entrant engagement members are nested together with one projection of each engagement member inserted in the indentation of the counter engagement member.

The outer cylinder of the bolt assembly may have means to prevent it from rotating in the holes of the first and second re-entrant engagement members.

The inner cylinder may have an annular slot made in the vicinity of its distal end, which annular slot is adapted to be caught by a counter pin, thereby preventing the bolt assembly from slipping off from the holes of the first and second reentrant engagement members upon locking.

Only the first and second re-entrant members are exposed outside, and therefore, the resistance to breaking can be increased simply by making these re-entrant members strong enough to prevent the breaking. Also, the auxiliary lock can be designed to be compact, and advantageously if an automatic dispenser has its door somewhat different from correct position relative to its body when closing, and if the automatic dispenser is locked by using the auxiliary lock, the door will be automatically put and held in correct position relative to the body of the dispenser.

Other objects of the present invention will be understood from following description of an auxiliary lock according to a preferred embodiment of the present invention.

DESCRIPTION OF THE PREFERRED EMBODIMENTS

Figure 1:
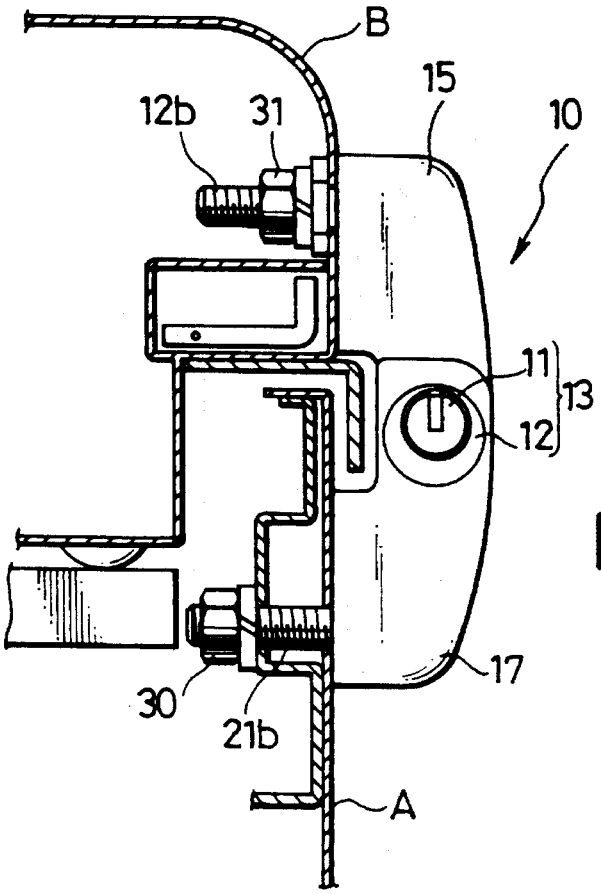
FIG. 1 is a bottom view of the auxiliary lock fixed to an automatic dispenser.
Figure 2:
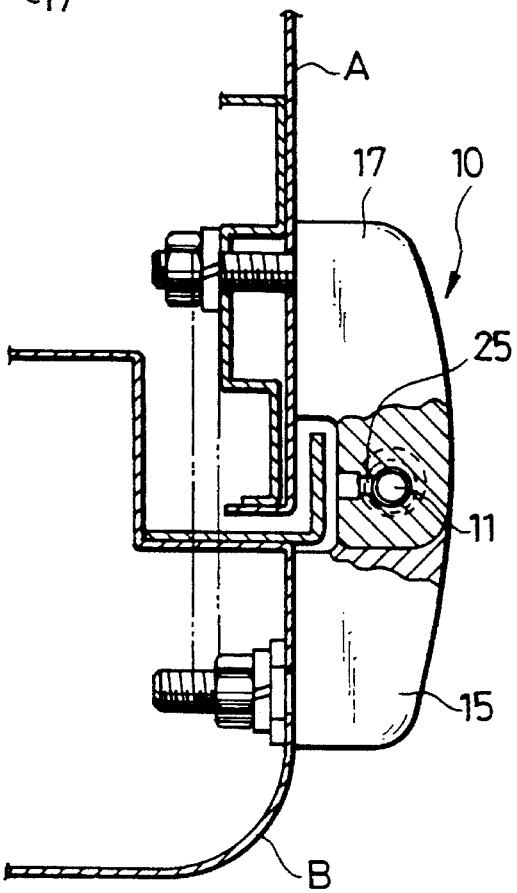
FIG. 2 is a top view of the auxiliary lock fixed to the automatic dispenser.

Referring to FIGS. 1 to 8, an auxiliary lock 10 for closing and fastening a movable part B to a stationary part A by means of a key according to the present invention comprises: a bolt assembly 13 comprising an inner cylinder 11 having a key hole and an outer cylinder 12 encircling the inner cylinder 11; a first re-entrant engagement member 15 to be fixed to the movable part B; and a second re-entrant engagement member 17 to be fixed to the stationary part A. The first and second re-entrant engagement members 15 and 17 have holes 19-1, 19-2 and 22-1, 22-2 made therein to be put in alignment when these re-entrant engagement members 15 and 17 are nested together with one projection 14-1 to 12-2 of each engagement member inserted in the indentation 14 or 16 of the counter engagement member.

Figure 3:
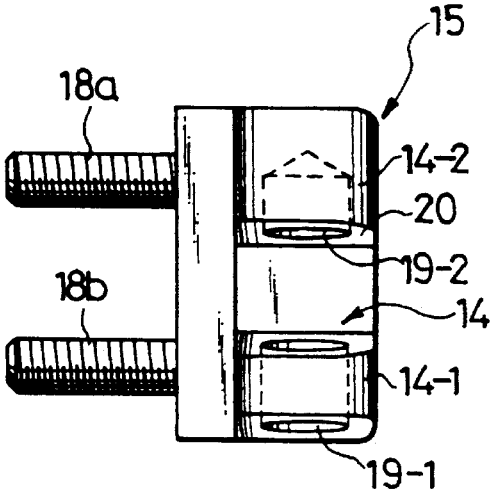
FIG. 3 is a side view of the first engagement member of the auxiliary lock.
Figure 4:
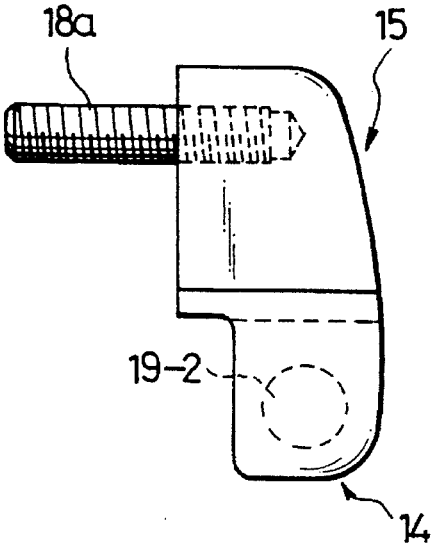
FIG. 4 is a plane view of the first engagement member.

Referring to FIGS. 3 and 4, the first re-entrant engagement member which is to be fixed to the movable part B, for example the door of an automatic dispenser has two stud bolts 18*a* and 18*b* for fastening to the door of the dispenser on one side, and two engagement projections 14-1 and 14-2 and one engagement indentation 14 therebetween on the other side. The engagement projection 14-1 has two tapered sides and one through hole 19-1 made therein, whereas the engagement projection 14-2 has one tapered side 20 facing the engagement indentation 14 and one blind hole 19-2 made in alignment with the through hole 19-1.

Figure 5:
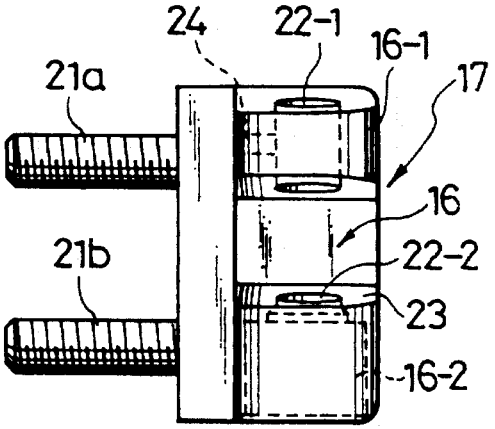
FIG. 5 is a side view of the second engagement member of the auxiliary lock.
Figure 6:
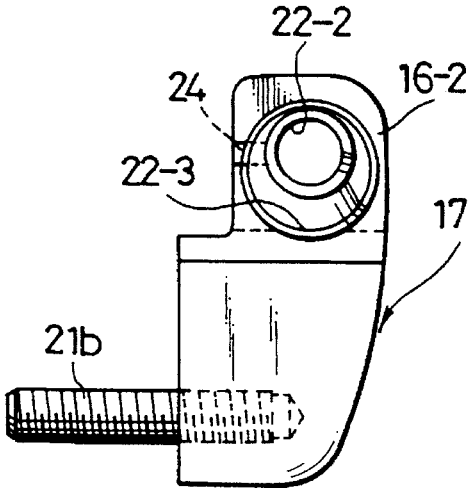
FIG. 6 is a plane view of the second engagement member.

Referring to FIGS. 5 and 6, the second re-entrant engagement member 17 which is to be fixed to the stationary part A, for example the body of the automatic dispenser has two stud bolts 21*a* and 21*b* for fastening to the body of the dispenser, and two engagement projections 16-1 and 16-2 and one engagement indentation 16 therebetween. The engagement projection 16-1 has two tapered sides and one through hole 22-1 made therein, whereas the engagement projection 16-2 has one tapered side 23 facing the engagement indentation 16 and one through hole 22-2 made in alignment with the through hole 22-1. The through hole 22-2 has a relatively small diameter hole section and a relatively large-diameter hole section 22-3, which has a bolt assembly press Fitted therein. As best seen from FIG.6, these hole sections are eccentric to each other. The relatively large-diameter hole section 22-3 has the outer cylinder 12 fitted therein, whereas the relatively small-diameter hole section has the inner cylinder 11 fitted therein. Thus, rotation of the inner cylinder 11 by means of a key causes no simultaneous rotation of the outer cylinder 12.

Figure 10A:
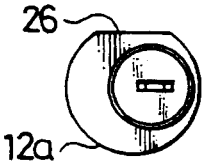
FIG. 10A and 10B show two different examples of bolt assemblies.
Figure 10B:
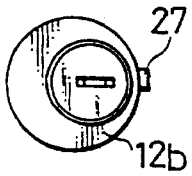

The projection 16-1 of the second re-entrant engagement member 17 has a pin hole 24 made perpendicular to the through hole 22-9 and an engagement pin 25 inserted in the pin hole 24. In this particular embodiment the inner and outer cylinders 11 and 12 are arranged to be eccentric to each other, thereby preventing the outer cylinder 12 from rotating. Alternatively the outer cylinder 12*a* may be chamfered as indicated at 26 to prevent the outer cylinder 12 from rotating, as seen from FIG. 10A. Then, the relatively large diameter hole section 22-3 has a counter for at projection to be complementary with the chamfered outer cylinder circumference 12*a*. Otherwise, the outer cylinder 12*b* may have a projection 27 on its circumference to prevent the outer cylinder 12 from rotating, as seen from FIG. 10B. Then, the relatively large-diameter hole section 22-3 has a counter recess to receive the projection 27 of the outer cylinder 12*b*.

The inner and outer cylinders 11 and 12 of the bolt assembly 13 are so constructed that these cylinders 11 and 12 may be rotatable each other by means of a key. Specifically, there is a driver pin or tumbler pin between the inner and outer cylinders 11 and 12, thereby permitting the rotating of these cylinders by means of an appropriate key. Also, the inner cylinder 11 has an annular slot 28 made in the vicinity of the distal end of the inner cylinder 11 and a longitudinal slot 29 communicating to the annular slot 28 and extending and ending at the distal end of the inner cylinder 11. The annular slot 28 is adapted to be caught by the pin 25, thereby preventing the bolt assembly 13 from slipping off from the holes 19 and 22 of the first and second re-entrant engagement members 15 and 17 upon locking.

In use, the second re-entrant engagement member 17 is fixed to the body A of the automatic dispenser by fastening the bolts 21*a* and 21*b* by associated nuts 30. The first re-entrant engagement member 15 is fixed to the door B of the automatic dispenser by fastening the bolts 18*a* and 18*b* by associated nuts 31. These re-entrant engagement members 15 and 17 are arranged so as to enable them to nest together in interdigitated relationship.

Figure 7:
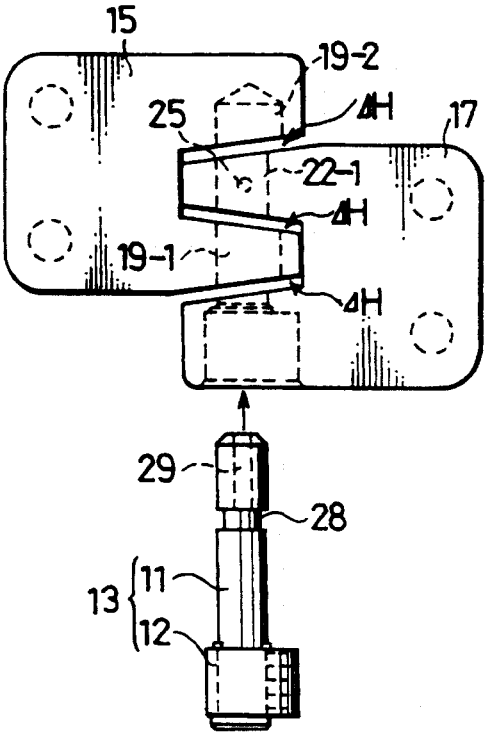
FIG. 7 shows the manner of hocking the movable part of the stationary part with the auxiliary lock.
Figure 8:
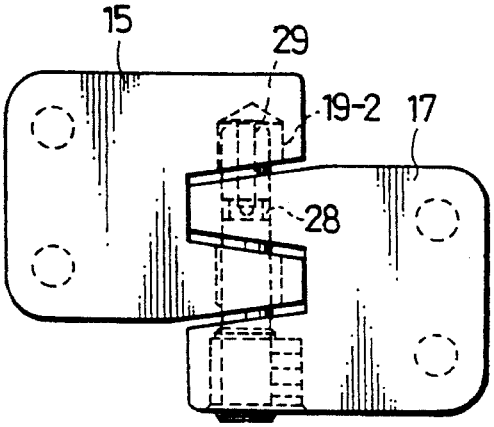
FIG. 8 shows the nesting of the first and second engagement members with the bolt assembly inserted therein in locking condition.
Figure 9A:
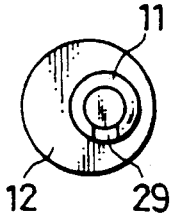
FIGS. 9A, 9B and 9C are left side view, longitudinal section and right side view of the bolt assembly.
Figure 9B:
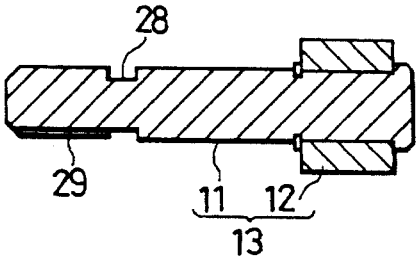
Figure 9C:
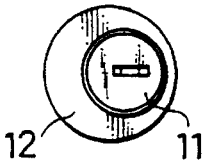

When the door B is closed, these re-entrant engagement members 15 and 17 are in the nesting condition in which the through holes 19-1, 19-2 and 22-1, 22-2 are aligned with each other to form a single through hole as best seen from FIG. 7.

The bolt assembly 13 is inserted in the single through hole thus formed, and then the engagement pin 25 of the second reentrant engagement member 17 runs in tile longitudinal slot 29 of the distal end of the inner cylinder 11 until the engagement pin 25 reaches the annular slot 28, and then, the inner cylinder 11 is rotated by means of the key, thereby catching the engagement pin 25 by the annular slot 28 to prevent the bolt assembly 13 from slipping off. Thus, the first and second engagement members 15 and 17 cannot be separated, thereby preventing the door B from opening.

As seen from FIG. 7, there are some clearances ΔH between adjacent projections of the re-entrant engagement members 15 and 17, and therefore, if the door B is somewhat displaced or tilted from the correct position by its weight, the locking and unlocking can be effected with ease.

In unlocking the inner cylinder 11 is rotated by means of the key until the longitudinal slot 29 of the distal end of the inner cylinder 11 is put in alignment with the engagement pin 25 of the second re-entrant member 17, and in this alignment position the bolt assembly 13 can be pulled out and removed the nested re-entrant members 15 and 17.

As may be understood from the above, only the first and second stout re-entrant members are exposed outside, thus increasing the resistance to breaking. Also, the auxiliary lock requires a minimum number of parts, and accordingly the manufacturing cost Is decreased. Even if an automatic dispenser has its door somewhat different from correct position relative to its body, the clearances between adjacent projections of the reentrant engagement members permit the self-repositioning of the door relative to the body of the dispenser.

I claim:

1. An auxiliary lock for closing and fastening a movable part to a stationary part using a key comprising: a bolt assembly comprising an inner cylinder having a key hole and an outer cylinder encircling one end of the inner cylinder, the inner cylinder and outer cylinder being rotatable relative to each other using the key; a first re-entrant engagement member, comprising an engagement, projection and defining an indentation adjacent the engagement projection, fixed to the movable part; and a second re-entrant engagement member, comprising an engagement projection and defining an indentation adjacent the engagement projection, fixed to the stationary part, said first re-entrant engagement member and said second re-entrant engagement member defining holes therein to be put in alignment when the first re-entrant engagement member and the second re-entrant engagement member are nested together, the engagement projection of each re-entrant engagement member inserted in the indentation of the counter re-entrant engagement member;

wherein said outer cylinder of said bolt assembly has means for preventing said outer cylinder from rotating in the holes of said first re-entrant engagement member and said second re-entrant engagement member while allowing said inner cylinder to rotate in the holes when the inner cylinder is unlocked from the first re-entrant engagement member and the second re-entrant engagement member using the key; and wherein said inner cylinder has a distal end, an annular slot made toward the distal end, a longitudinal slot made at the distal end and communicating with the annular slot, wherein the annular slot is adapted to be caught by a counter stud pin mounted on a surface of the holes, thereby preventing said bolt assembly from slipping off said holes of said first re-entrant engagement member and said second re-entrant engagement member upon locking.

2. An auxiliary lock according to claim 1, wherein said preventing means comprises a through hole defined in one of said first re-entrant engagement member and said second re-entrant engagement member, the through hole having a small-diameter hole section having the inner cylinder fitted therein and a large-diameter hole section having the outer cylinder fitted therein, wherein said inner cylinder and said outer cylinder are eccentric to each other.

* * * * *